US005324396A

United States Patent [19]

Ferron et al.

[11] Patent Number: 5,324,396

[45] Date of Patent: Jun. 28, 1994

[54] METHOD AND ELECTROLYTIC CELL FOR METAL RECOVERY

[76] Inventors: Philippe Ferron, 95 Place Massey, St. Bruno, Canada, J3V 1A2; Camil Prince, 5959 Magnan, St. Hubert, Quebec, Canada

[21] Appl. No.: 9,672

[22] Filed: Mar. 26, 1993

[30] Foreign Application Priority Data

Jan. 29, 1992 [CA] Canada ..... 2060264

[51] Int. Cl.[5] ..... C25C 1/00; C25C 7/00; C25C 7/06

[52] U.S. Cl. ..... 204/105 R; 204/109; 204/257; 204/258; 204/269; 204/284; 204/293; 204/294; 75/10.18

[58] Field of Search ..... 204/253, 254, 255-258, 204/284, 292-293, 269, 267, 105 R, 270, 109, 294; 75/10.18

[56] References Cited

U.S. PATENT DOCUMENTS

| | | | |
|---|---|---|---|
| 3,450,622 | 6/1969 | Cothran | 204/109 X |
| 3,708,415 | 1/1973 | Hubbard | 204/257 |
| 4,172,780 | 10/1979 | Kammel et al. | 204/213 |
| 4,639,302 | 1/1987 | Everett | 204/258 |
| 4,857,162 | 8/1989 | Phillips et al. | 204/257 |
| 4,863,580 | 9/1989 | Epner | 204/269 |

*Primary Examiner*—Donald R. Valentine
*Attorney, Agent, or Firm*—Eric Fincham

[57] ABSTRACT

There is provided improvements in systems and methods for the recovery of ferrous or non-ferrous metals in an electrolytic cell system. The improvements include an automated process and system and an electrolytic cell which includes means for removing a plated metal from the anode/cathode to permit it to settle at the floor of the cell and means for removing the settled metal therefrom.

11 Claims, 7 Drawing Sheets

METHOD AND ELECTROLYTIC CELL FOR METAL RECOVERY

The present invention relates to systems and methods for recovery of non-ferrous metals and more particularly, it relates to improvements in electrolytic cells and systems using the electrolytic cell.

Electrolytic cells are well known in the art and have been used for many different purposes throughout the years. Recently, improved processes for the recovery of metals such as gold have involved the use of electrolytic cells as part of the carbon in pulp process for replacement of the old Merrill Crow Process. One of the advantages of the processes used is the elimination of pollution.

It is an object of the present invention to provide an improved electrolytic cell having minimum maintenance and maximum operation duty capabilities and which is suitable for use in the recovery of precious non ferrous or ferrous metals.

It is a further object of the present invention to provide a cathode suitable for use in an electrolytic cell and which cathode has means for removing plated material therefrom.

It is a further object of the present invention to provide an automated system and process for use with an electrolytic cell for the recovery of metals.

According to one aspect of the present invention, there is provided an electrolytic cell having a cell body of a substantially rectangular configuration, a plurality of alternating anodes and cathodes, a separator intermediate each anode and cathode, means for supplying electric current to the anodes and cathodes, a sloping floor spaced from the bottom of the anodes and cathodes, the sloping floor leading to a drain, and spray means for directing sediment to the drain.

In a further aspect of the present invention, there is provided an improvement in an electrolytic cell which includes a plurality of alternating anodes and cathodes, the improvement comprising a cathode having a frame member and material mounted on said frame member on which a metal can plate, the frame member including spray means mounted thereon to dislodge plated material from the cathode.

In a further aspect of the invention, there is provided an automated system for the recovery of metals comprising an electrolytic cell having a fluid inlet, a fluid outlet, a drain located proximate the bottom of the cell, a plurality of alternating anodes and cathodes, and means for supplying electric current to the anodes and cathodes. The system includes for removing material from the floor to the drain and means for taking the material from the drain to a filter press. At the filter press, there are means for removing excess liquid to concentrate the material and conveying means to convey the concentrated material to an induction furnace.

There is also provided a method of recovery of a metal from a solution comprising the step of supplying an electrolytic cell having an inlet at one end and an outlet at an opposed end, a drain located proximate the bottom of the cell and having a plurality of alternating anodes and cathodes spaced from the cell bottom. The method includes the step of pumping a solution into the electrolytic cell at one end thereof, applying direct current to the anodes and cathodes to thereby plate metal from the solution, removing the metal from the cathode and permitting the metal to settle to the bottom of the cell, directing the metal by spraying to the drain, pumping the metal to a filter press, removing excess moisture to form a concentrate, and conveying the concentrate to an induction furnace to melt the metal.

In greater detail, the electrolytic cell is preferably of a conventional generally overall rectangular configuration having a pair of opposed side walls, a pair of opposed end walls, a base or floor, and a cover member. The cell may be formed of known suitable materials; in a preferred embodiment, it is formed of a glass fiber reinforced material such as plastic. If required, reinforcing members may be employed to add greater strength to the structure. The cell, depending upon the structure, may either sit directly on the floor or on a suitable support member.

The interior of the cell has, in a conventional manner, a plurality of alternating spaced anodes and cathodes. However, the present invention provides a system of slides such that ready access may be had for maintenance and replacement.

In a preferred embodiment, slide members are provided on the opposed side walls for receiving the anodes, cathodes and separators (which are interposed between the anodes and cathodes). The slides may either be formed integrally with the side walls or alternatively, they may be formed as a separate unit suitable secured to the side wall. The slides will consist of a groove formed therein to receive the anode, cathode or separator as appropriate.

Many types of anodes are known and conventionally in electrolytic cells of the type discussed herein, the anodes are formed of a wire mesh. However, according to the preferred embodiment of the present invention, the anode is formed of foraminous sheet metal which has been found to function substantially better than the wire mesh. The anode, in the form of the sheet metal, may have a frame member on opposes sides thereof adapted to fit within the slide as previously discussed. Also, at the top, there is provided a contact member adapted to engage a bus bar for supplying current thereto and a support member.

The cathode, in the preferred embodiment, is formed of a steel wool within a suitable frame. The steel wool may be either stainless (in which the gold falls off) or non stainless in which case the steel wool is destroyed for recovery of the gold. The frame member will fit within the slide on the sides of the cell walls. Also, the frame member will in include a contact portion for engaging the bus bar for supplying current thereto as well as a support portion as will be described in greater detail hereinbelow.

The cathode, in a particularly preferred embodiment, will utilize a frame member which is a hollow tube and has a plurality of spray means thereon for removal of the plating material therefrom. In other words, the frame of the cathode would be connected to a fluid supply means and the fluid would be sprayed from the nozzles to dislodge the plated material to thereby completely eliminate the labour otherwise required for the same.

Interposed between each anode and cathode is a separator. Each separator is encased in a frame member and is formed of a suitable material such as a polypropylene. Thus, one may have sheet polypropylene material with a frame of polypropylene adapted to fit within the slides. The sheet polypropylene material will have a plurality of apertures therein to permit the passage of the fluid. In one particular embodiment, the arrangement of the apertures may be such that a portion of the separator is solid while a further portion is perforated. For example, one could have a top half of a first separator with perforations with the bottom half being solid. The subsequent separator could utilize an alternate arrangement with the top half being solid and the bottom half being perforated. This arrangement can be varied to be a desired pattern to permit maximum efficiency and distribution of the plating solution over the cathodes. Support members are provided as will be discussed hereinbelow.

The above described members (anodes, cathodes and separators) are all designed to sit above the base or floor of the cell to leave a space therebetween. The floor is provided with a double slope to a drain portion formed therein. In other words, the base or floor slopes from one end to the other while it also slopes downwardly from the side walls or at least one of the side walls.

Located adjacent to the side walls are fluid supply means for supplying water or other fluid which are directed out through multi-directional nozzles mounted therein to remove sediment from the floor and towards the drain.

The cell will include suitable inlet and outlet means for the fluid and a cover member is also provided.

The above described electrolytic cell is preferably used in a automated system which will permit operation of the electrolytic cell with minimum operator intervention and maximum security when precious metals such as gold are being recovered. The automated system will include a pump to remove material from the drain and convey the same to a filter press. At the filter press, there may be an air assisted drying step to help remove any excess moisture from the concentrate. Subsequently, the concentrate is moved to a discharge hopper. At the discharge hopper, conveying means preferably comprising a tubular conveyor is provided for moving the concentrate to a further hopper. At the hopper, the concentrate may be discharged into an induction furnace.

Having thus generally described the invention, reference will be made to the accompany drawings, illustrating an embodiment thereof, in which.

Figure 1:
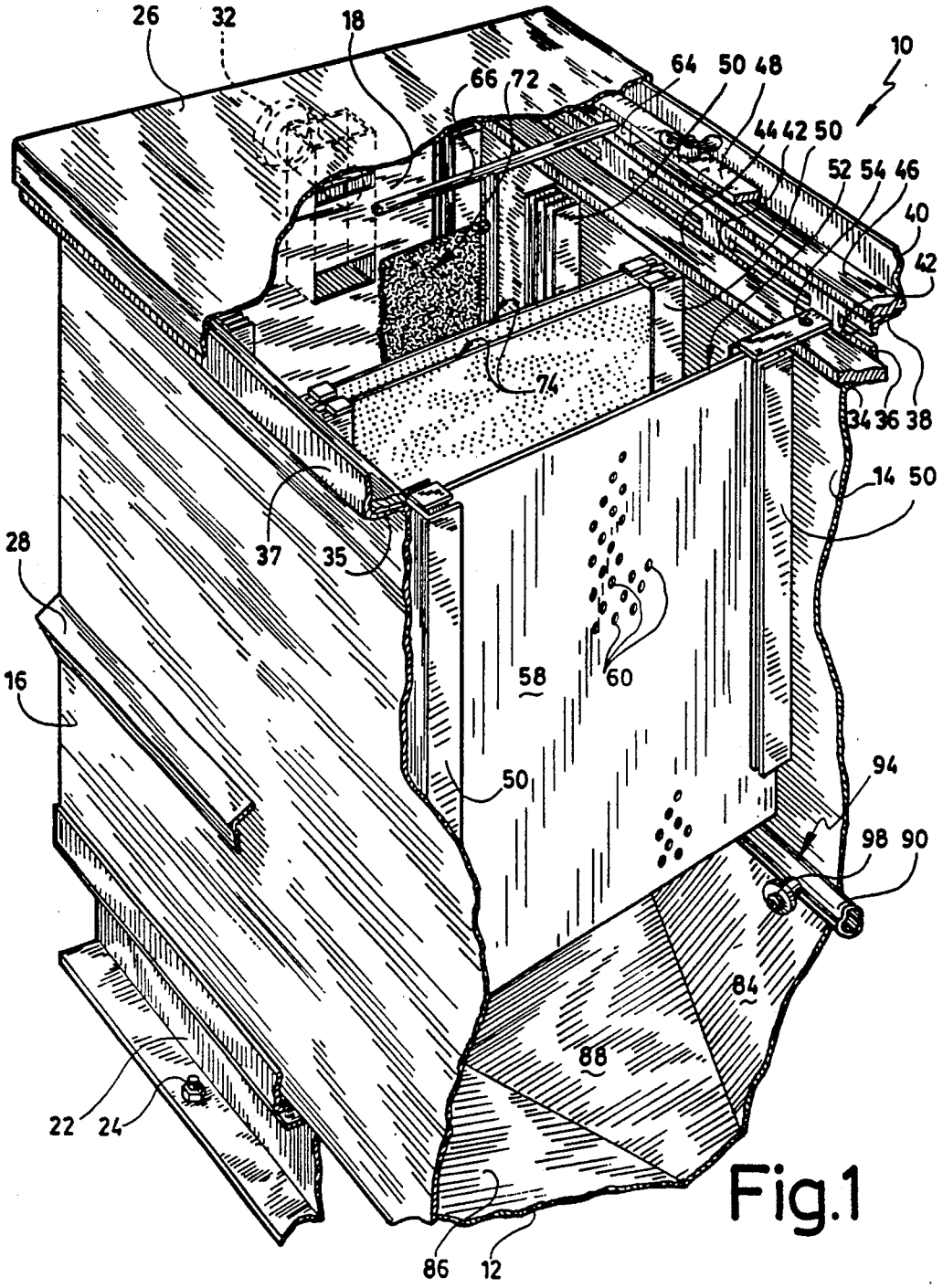
FIG. 1 is a perspective view, in partial cutaway, of an electrolytic cell.

Referring initially to FIG. 1, there is illustrated that an electrolytic cell 10 which has a base 12, opposed side walls 14 and 16, and opposed end walls 18 and 20 to provide an overall rectangular configuration. Cell 10 has a cover 26 and the cell may be mounted on a suitable support member 22 which is secured to the floor by bolts 24. A reinforcing frame member 28 extends about the periphery of the cell walls as may be seen in FIG. 1.

Figure 3:
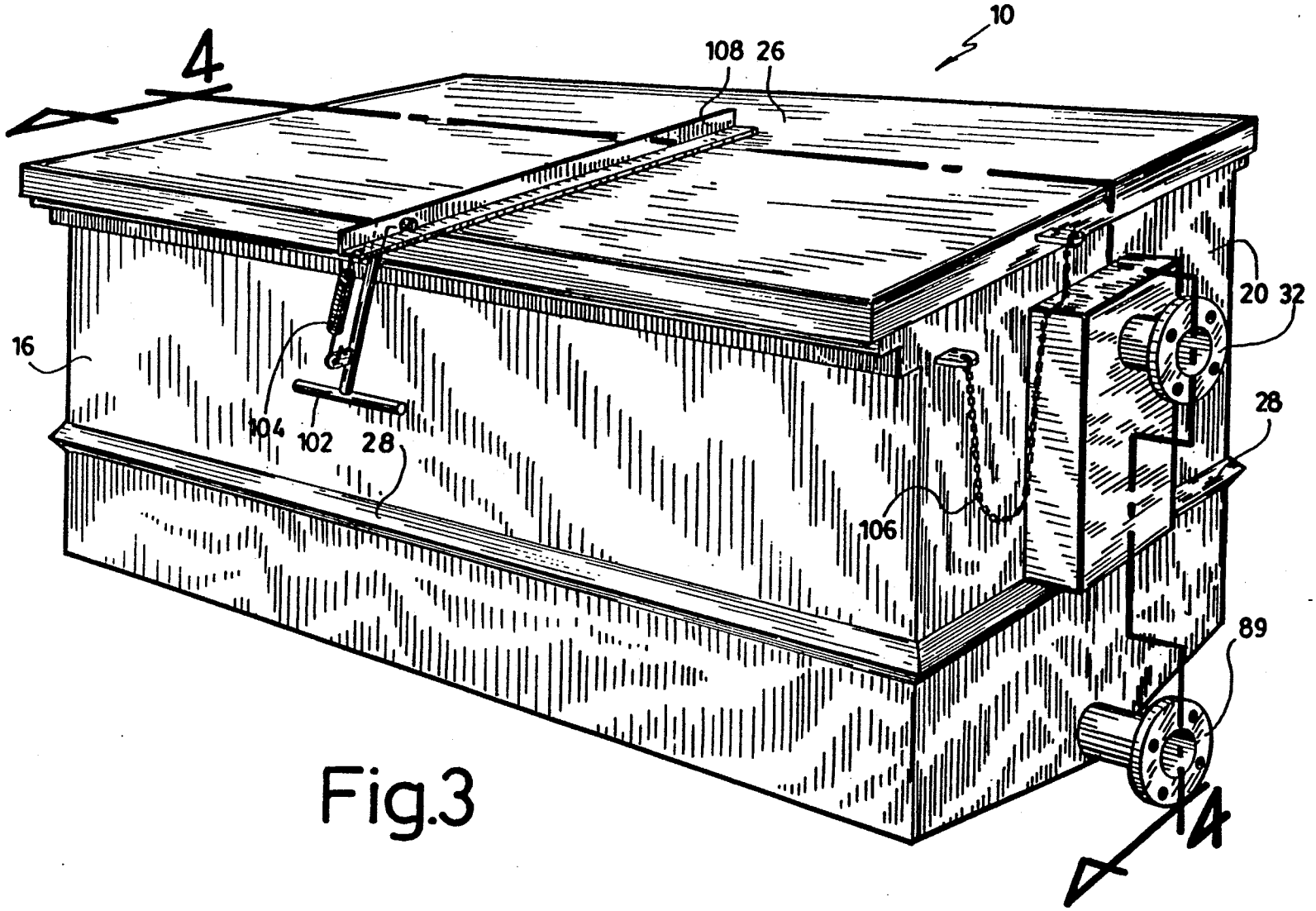
FIG. 3 is a perspective view of the exterior of an electrolytic cell.
Figure 4:
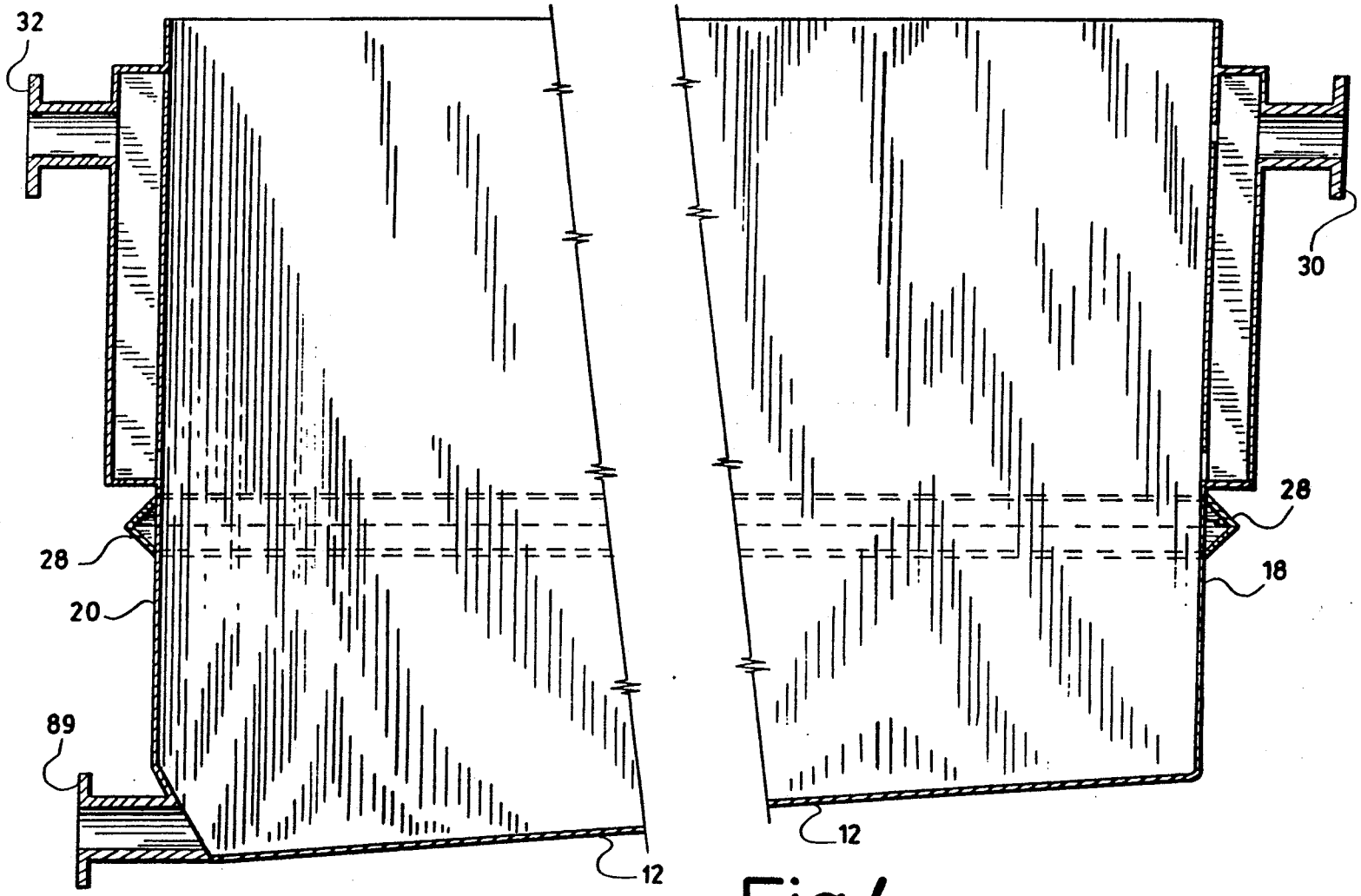
FIG. 4 is a side elevational view of the spray system in the electrolytic cell.
Figure 5:
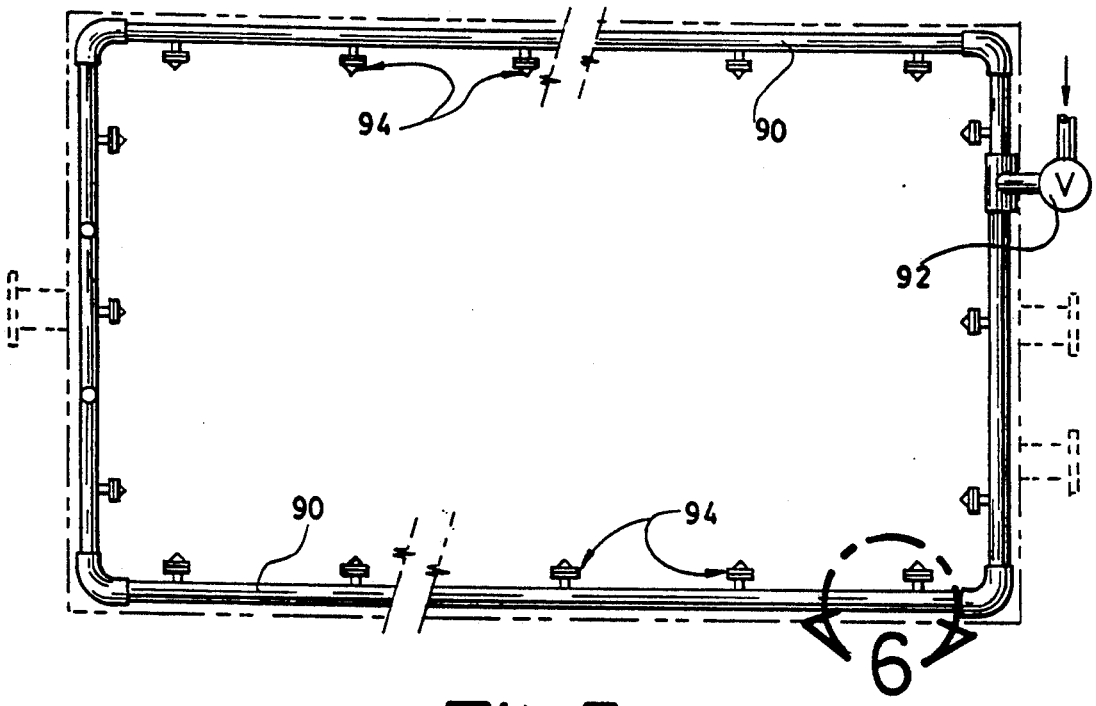
FIG. 5 is a top plan view of the spray system of FIG. 4.
Figure 6:
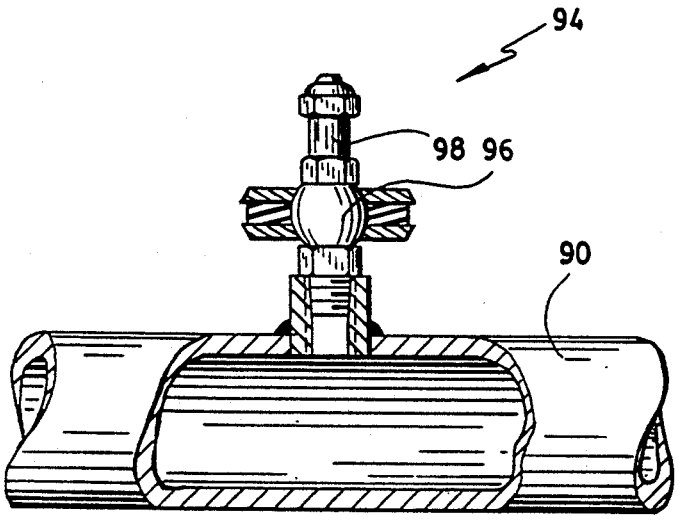
FIG. 6 is a sectional view of a spray nozzle.

As may be seen from FIGS. 1 and 3, an inlet 30 is provided in end wall 20 with outlet 32 being provided in end wall 18.

Side wall 14, at its upper portion, extends outwardly to provide a first ledge 34. An upper vertical portion 36 joins the end of ledge 34 to extend horizontally to provide a second ledge 38. A vertically extending flange 40 extends from second ledge 38. As may be seen from FIG. 1, a plurality of venting apertures 42 are provided in vertically extending wall 36.

Mounted on ledge 34 is a bus bar 44 which is connected to the positive terminal of an electrical supply means (not shown) A bus bar 46 is connected to the negative supply terminal. Bus bar 46 is held in position by means of a contact bar 48.

The materials used, as previously mentioned, may be various types of plastic materials. Particularly at the bus bar area, it is desirable to use an insulating material such as a glass fiber reinforced composite to reduce and/or minimize the potential damage to the fiber reinforced plastic from excessive heat generated by electric current going through the bus bars.

Mounted on side walls 14 and 16 are a plurality of slide members generally designated by reference numeral 50. Slide members 50 are adapted to provide for ease of access to the interior members of the cell as discussed hereinbelow.

Mounted within slide members 50 are anodes 52, cathodes 62 and separators 74. The structure of each of these elements is shown in greater detail in FIGS. 2A, 2B and 2C and will now be referred to.

Anode 52 is formed of a sheet 58 of a suitable material such as stainless steel ⅛" thick. A plurality of apertures 60 are provided throughout plate 58. At one upper side edge, a contact member 54 is provided while at the other upper side edge, a support member 56 is mounted. As may be seen in FIG. 1, contact member 54 is in contact with bus bar 44 to maintain a positive electrical potential for anode 52.

Cathode 62 has a side frame portion 70 and an upper frame portion 66. A contact portion 64 is in contact with bus bar 46 while support 68 supports the other side of the cathode. Steel wool 72 is mounted over a portion of the upper frame 66.

Figures 2A, 2B, 2C:
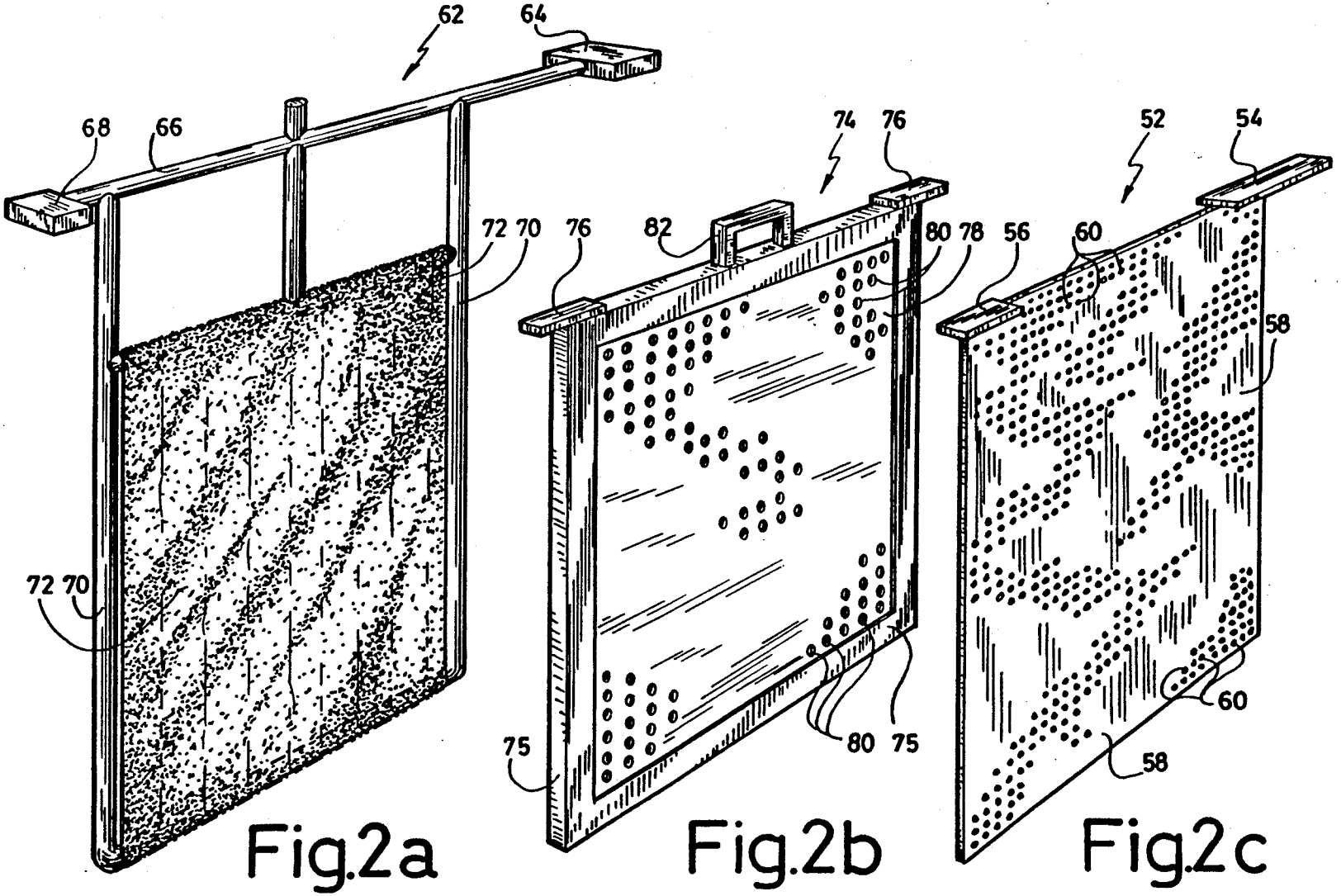
FIGS. 2A, 2B and 2C are side elevational views of the cathode, separator and anode elements respectively.

Each separator 74, as shown in FIG. 2B, has a frame 75 about the main portion 78 of the separator which consists of polypropylene approximately ⅛" thick. A plurality of apertures 78 are provided therein. At either upper side edge are support members 76 while a handle 82 is provided.

Each of anodes 52, cathodes 62 and separators 74 are sized to be spaced a distance from floor 12. As may be seen in FIG. 1, extending from side wall 16 is a sloping floor portion 86 with a further sloping portion 84 extending downwardly from side wall 14. A central sloping portion 88 extends from end wall 18. Sloping portions 84, 86 and 88 all slope to a drain 89 as may be seen in FIG. 3.

Mounted along the side walls and end wall is a fluid supply tubing 90 having an inlet 92 for supplying fluid thereto and a plurality of nozzles generally designated by reference numeral 94. Nozzles or valves 94 have a rotatable joint 96 which connects to a spray head 98 which are adapted to spray the floor 12 of cell 10 to direct any sediment to drain 89.

Figure 7C:
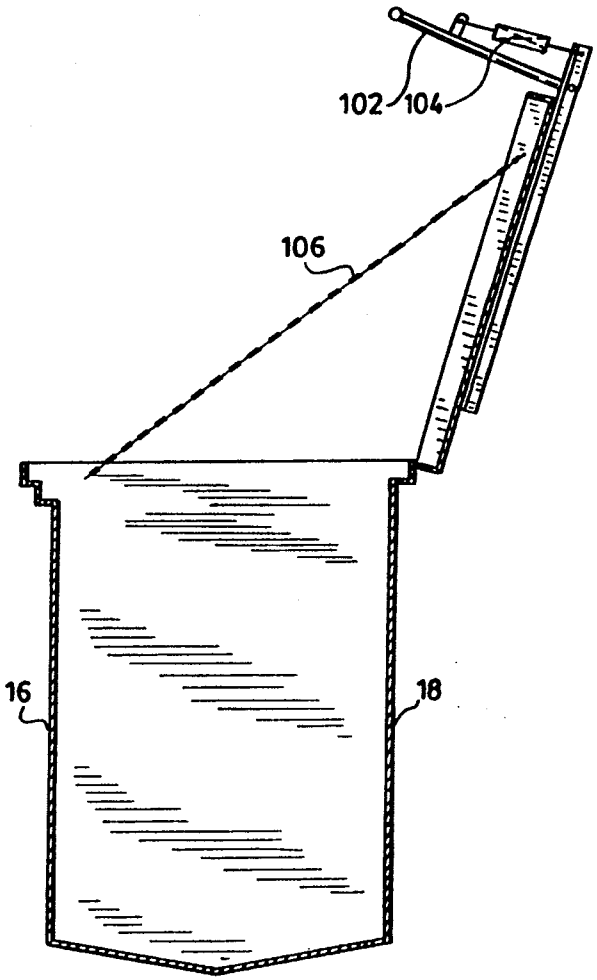
FIGS. 7A, 7B and 7C are side elevational views of the electrolytic cell showing opening of the cover member.
Figure 7B:
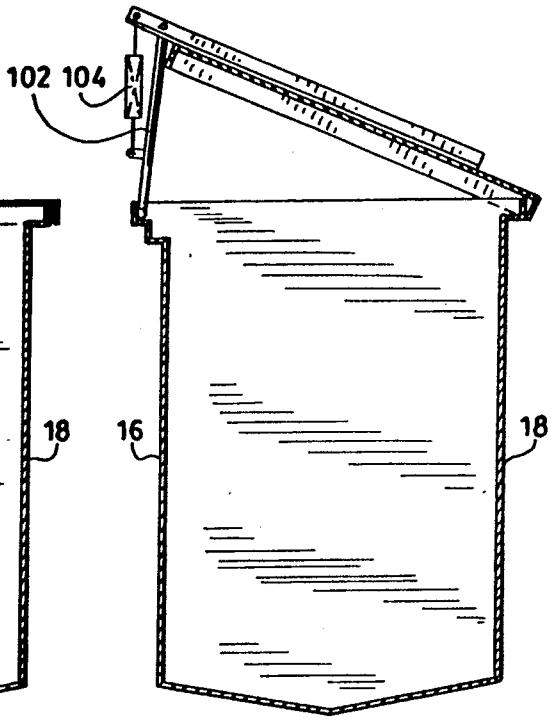
Figure 7A:
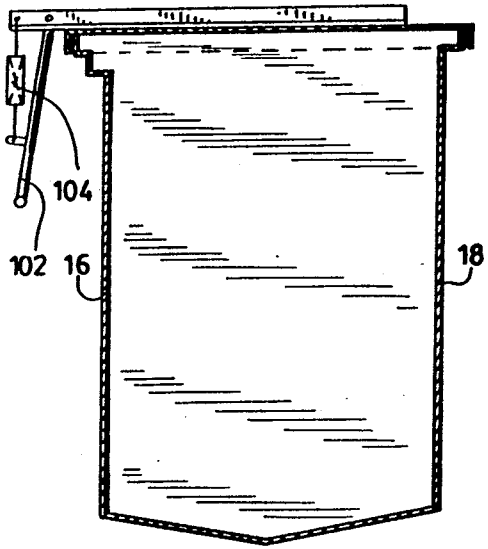

Cover member 26, as may be seen in FIGS. 7A, 7B and 7C have a cover reinforcing member 108 to which is secured a handle 102. A spring 104 has one end secured to cover 26 with a further end secured to handle 102. As shown in FIG. 7B, the cover may be partially open with handle 102 being used as a propping member to retain the cover in an open position for inspection. Further movement will permit the cover to be completely opened for access to permit removal of the components. A retaining cable 106 may be provided to limit the degree of opening of the cover.

Figures 8, 9:
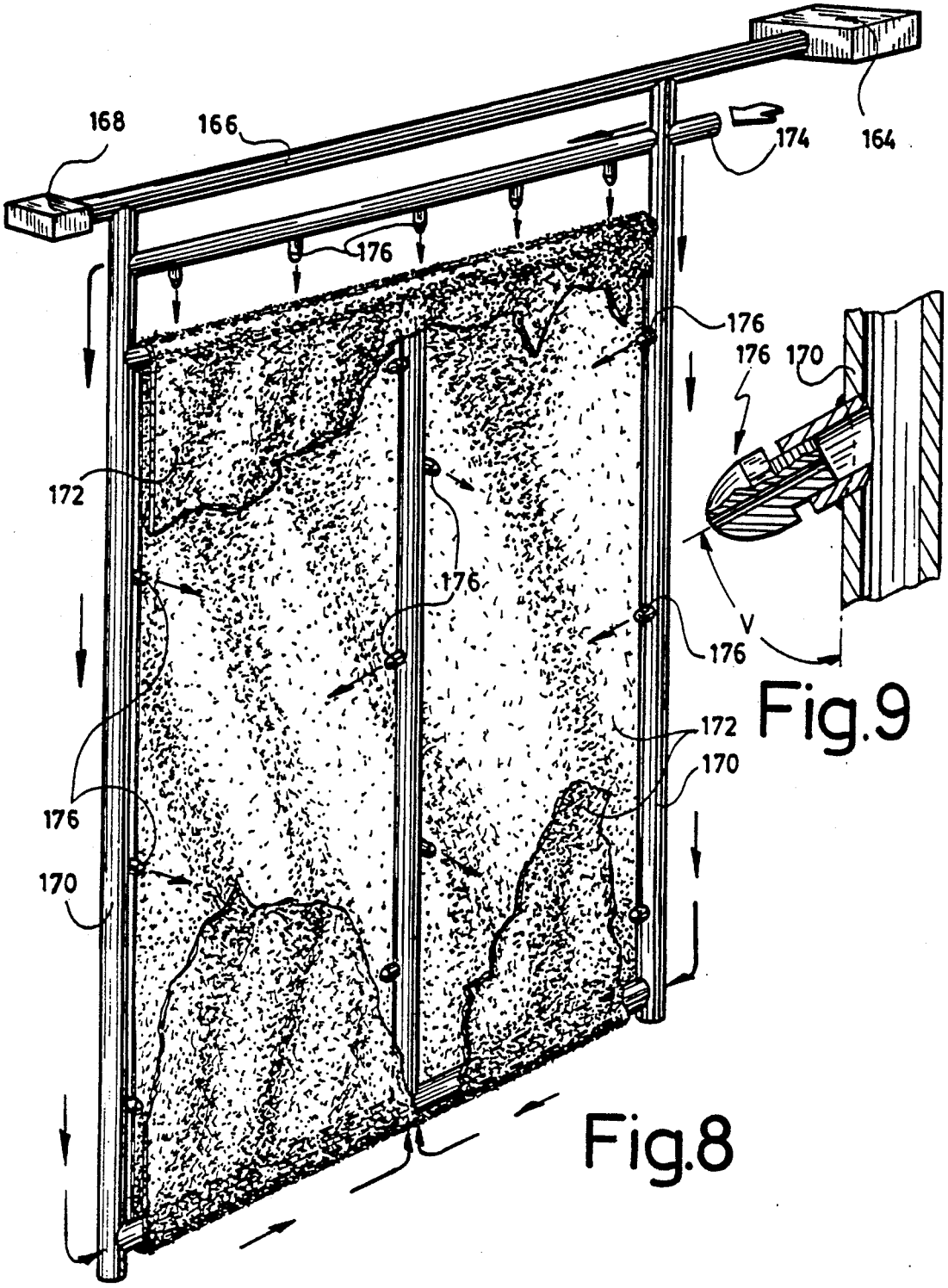
FIG. 8 is an elevational view of a preferred cathode according to the present invention.
FIG. 9 is a sectional view of a nozzle assembly of the cathode.

Referring to FIG. 8, a cathode 162 according to a preferred embodiment of the present invention is illustrated. Cathode 162 has a side frame portion 170 and an upper frame portion 166. A contact member 164 is adapted to be in contact with a bus bar, a support member 168 supports the other side of the cathode. Steel wool 172 is mounted over upper frame portion 166. Side frame portion 170 is hollow and an inlet 174 is provided for connection to a source of fluid. Inlet 174 preferably has a quick connect/disconnect coupling associated therewith. Mounted on frame portion 170 are a plurality of nozzles 176 which are directed to spray steel wool 172 to remove material which is plated thereon. Thus, when it is desired to remove the plated material from the steel wool, nozzles 176 can spray water with sufficient force to dislodge plated material from the steel wool 172.

A nozzle assembly as shown in FIG. 9 and as illustrated, includes a nozzle head which is screw threadly engageable with an outlet in member 170. If desired, the nozzles can be arranged so as to be flexible and allow the desired orientation for maximum effectiveness in the spraying.

The electrolytic cell described above may be utilized in a process which is automated such that following removal of the plated metal and settling of the same in the bottom of the cell, a pump may be provided to remove the material to a filter press from where excess fluid is removed while the concentrate may be taken by a conveyer to a hopper for feeding to induction furnace.

It will be understood that the above described embodiment is for purposes of illustration only and changes and modifications may be made thereto without departing from the spirit and scope of the invention.

We claim:

1. An electrolytic cell comprising a cell body of a substantially rectangular configuration, a plurality of alternating anodes and cathodes, a separator intermediate each of said anodes and said cathodes, means for supplying electric current to said anodes and said cathodes, a sloping floor spaced from the bottom of said anodes and said cathodes, drain means in said sloping floor located proximate a low point therein, spray means to direct sediment to said drain means, and a cover member adapted to fit on the top of said cell.

2. The electrolytic cell of claim 1 further including ventilation means providing ventilation between the interior and exterior of said cell.

3. The electrolytic cell of claim 1 wherein said spray means are located proximate the body of said cell and the sloping floor, said spray means comprising a plurality of individual spray heads connected to fluid supply means.

4. The electrolytic cell of claim 1 wherein said anodes are formed of a foraminous sheet material.

5. The electrolytic cell of claim 1 wherein said cell body has a pair of opposed side walls and a pair of opposed end walls, each of said pair of opposed side walls having a plurality of slide members thereon, said slide members being adapted to receive said anodes, cathodes, and separators.

6. A cathode suitable for use in an electrolytic cell, said cathode having a frame member, steel wool mounted in said frame, and nozzles connected to a fluid supply means for spraying a fluid on said steel wool to remove plated material therefrom.

7. The cathode of claim 6 wherein said frame member has a fluid passage therein, said nozzles being connected to said frame member to thereby spray fluid on said steel wood.

8. A method for the recovery of a metal from a solution/slurry suspension comprising the step of supplying an electrolytic cell having an inlet at one end and an outlet at the opposed end, a drain located proximate the bottom of the cell, a plurality of alternating anodes and cathodes spaced from the cell bottom, pumping a solution/slurry/suspension into said electrolytic cell at one end thereof, applying direct current to said anodes and cathodes to thereby plate the metal from the solution, removing the metal from the anode/cathode and permitting the metal to settle to the bottom of said cell, directing said metal by spraying to remove the metal to the discharge outlet, pumping said metal to a filter press, removing excess moisture at said filter press to concentrate said metal, and conveying said concentrate to an induction furnace to melt said metal.

9. A system for the recovery of metals comprising electrolytic cell having a fluid inlet, a fluid outlet, and a drain, a plurality of alternating anodes and cathodes, means for supplying electric current to the anodes and cathodes, means for removing material from the floor to said drain, means for pumping said material to a filter press, said filter press having means for removing excess liquid to concentrate said material, and conveying means for conveying said concentrate to an induction furnace.

10. An electrolytic cell comprising a cell body of a substantially rectangular configuration, a plurality of alternating anodes and cathodes, a separator intermediate each of said anodes and said cathodes, means for supplying electric current to said anodes and said cathodes, each of said cathodes comprising steel wood mounted in a frame member, said frame member having a portion thereof in electrical communication with the steel wool and said means for supplying electricity to said cathode, a sloping floor spaced from the bottom of said anodes and said cathodes, drain means in said sloping floor located proximate a low point therein, and spray means to direct sediment to said drain means.

11. The electrolytic cell of claim 10 further including means for spraying a fluid on said steel wood to remove plated material therefrom.

* * * * *